US008805239B2

(12) United States Patent
Jader et al.

(10) Patent No.: US 8,805,239 B2
(45) Date of Patent: Aug. 12, 2014

(54) ACTUATION DEVICE FOR PRESSURE ROLLERS

(75) Inventors: Lennardt Jader, Strande (DE); Peter Schmidt, Kiel (DE)

(73) Assignee: Eastman Kodak Company, Rochester, NY (US)

( * ) Notice: Subject to any disclaimer, the term of this patent is extended or adjusted under 35 U.S.C. 154(b) by 467 days.

(21) Appl. No.: 13/133,393

(22) PCT Filed: Nov. 27, 2009

(86) PCT No.: PCT/EP2009/065954

§ 371 (c)(1),
(2), (4) Date: Oct. 14, 2011

(87) PCT Pub. No.: WO2010/066595

PCT Pub. Date: Jun. 17, 2010

(65) Prior Publication Data

US 2012/0021881 A1 Jan. 26, 2012

(30) Foreign Application Priority Data

Dec. 12, 2008 (DE) ..... 10 2008 061 929

(51) Int. Cl.
*G03G 15/08* (2006.01)

(52) U.S. Cl.
USPC ..... 399/121; 399/299

(58) Field of Classification Search
USPC ..... 399/107, 116, 117, 121, 297–303
See application file for complete search history.

(56) References Cited

U.S. PATENT DOCUMENTS

| | | | | |
|---|---|---|---|---|
| 6,061,542 | A * | 5/2000 | Minami et al. | 399/299 |
| 7,424,947 | B2 * | 9/2008 | Nakano | 198/814 |
| 7,561,840 | B2 * | 7/2009 | Morimoto et al. | 399/299 |
| 2003/0223785 | A1 | 12/2003 | Kanekura et al. | |
| 2007/0116496 | A1 | 5/2007 | Morimoto et al. | |

FOREIGN PATENT DOCUMENTS

| | | |
|---|---|---|
| JP | 09/138533 | 5/1997 |
| JP | 09/274355 | 10/1997 |

* cited by examiner

*Primary Examiner* — Hoan Tran

(57) ABSTRACT

In a device for moving a plurality of pressure rollers relative to respective counter rollers in a printing machine, it is possible to provide a simple design of this device, wherein, in a non-energy mode, the pressure rollers are arranged in a non-contact position. For this purpose, the device includes a plurality of movably supported pressure roller carriers that each support one pressure roller, the pressure roller carriers being movable between a contact position and a non-contact position. In this arrangement, each of the pressure roller carriers is biased in the direction of the contact position via a biasing unit. Furthermore, at least one actuation element is provided, the actuation element connecting at least two pressure roller carriers to a shared actuation device.

17 Claims, 6 Drawing Sheets

ACTUATION DEVICE FOR PRESSURE ROLLERS

TECHNICAL FIELD OF THE INVENTION

The present invention relates to an actuation device for moving a plurality of pressure rollers relative to respective counter rollers in a printing machine.

BACKGROUND ART OF THE INVENTION

In the printing industry and, in particular, in electrophotographic printing machines, it is known to provide a printing nip by biasing a pressure roller in the direction of an image carrier roller as the counter roller. Usually, the transfer of an electrophotographically generated toner image from the image carrier roller to the printing material takes place in the printing nip. Multi-color printing machines frequently comprise several printing units, each with their own printing nips, so that a plurality of oppositely arranged pairs of pressure rollers and counter rollers is provided. Usually, the pressure rollers and the counter rollers can be moved into a position of contact with each other and away from each other into a separated position. In particular when the image carrier rollers is elastic, it is necessary to lift the pressure rollers off the image carrier roller when the printing machine is at rest in order to prevent an indentation of the image carrier roller. Furthermore, in the separated position, it is possible to pull printing material sheets, or other materials or substrates that are to be printed, out of the printing nip in order to eliminate material jams when malfunctions occur. Optionally, it would also be possible to adjust the contact pressure in the printing nip by means of the above movement. Therefore, in order to perform the required movement of the pressure rollers, known printing machines comprise individual actuation devices for the respective pressure rollers. However, the use of individual actuation devices can result in space problems within the printing machine and, in addition, be cost-intensive. In addition, the synchronous control of said devices is expensive and complex. Therefore, the problem may arise that the contact pressure between the pressure roller and the counter roller is different for the different successively arranged printing nips in a printing machine, which has a disadvantageous effect on the printing process.

SUMMARY OF THE INVENTION

Therefore, it is an object of the present invention to provide a simple device for moving the pressure rollers in printing machines, and more particularly, providing for a device and a method for moving a plurality of pressure rollers.

In order to achieve the object, the invention provides a device for moving a plurality of pressure rollers relative to respective counter rollers in a printing machine comprising a plurality of movably supported pressure roller carriers that each support one pressure roller, said pressure roller carriers being movable between a contact position and a non-contact position. Each of the pressure roller carriers is biased in the direction of the contact position via a biasing unit. At least one actuation element is provided, said actuation element connecting at least two pressure roller carriers to a shared actuation device. As a result of this design, it becomes possible to move a plurality of pressure rollers by means of only one actuation element, and thus fewer components are required and costs are saved. Furthermore, a specific contact pressure can be achieved with the biasing units in a simple manner, whereby said contact pressure can be adjusted uniformly, or also individually, for all the pressure rollers.

Preferably, the actuation device has only one actuated and one non-actuated position. Intermediate positions of the actuation device are not necessary. As a result of this, the control of said device is simplified and position sensors are not necessary.

Advantageously, the actuation device is a pneumatic actuation device, a hydraulic actuation device or an electromagnetic actuation device because such actuation devices are available as cost-effective standard industrial components in many modifications. As a result of this, e.g., it is ensured in case of power loss that the pressure rollers are automatically moved into a non-contact position.

Preferably, the pressure roller carriers are in the non-contact position when the actuation device is in its non-energy mode. If the pressure rollers are not pressed against the counter rollers, it can be avoided, in particular in the case of elastic rollers, that a flattening of the recess of the roller material occurs in the region of contact, which flattening might initially result in problems when the printing machine is restarted.

Preferably, the pressure roller carrier supports the pressure roller so that said pressure roller can be pivoted relative to the counter roller in order to ensure a precise guiding of the rollers relative to each other. In particular, the pressure roller carriers have an L-shape, the pivot axle being arranged in the region of a bend of the L-shape. Thus, the force of the weight of the pressure roller has the effect that said force moves the pressure roller, in non-actuated state of the actuation device, away from the counter roller.

Advantageously, the contact region between the pressure roller and the counter roller is essentially vertically below the axis of rotation of the counter roller. As a result of this, well-defined kinematic conditions are created, and it is easier to achieve a defined force of contact pressure between the rollers.

Depending on the specific design of the pressure roller carrier, the biasing unit is arranged between the pressure roller carrier and a fixed frame of the printing machine, or the biasing unit is arranged between the pressure roller carrier and the actuation element.

In the non-contact position of the pressure rollers, the biasing unit is preferably at least partially unbiased relative to the contact position in order to reduce any stressing of said pressure rollers.

Preferably, the biasing unit comprises at least one tension spring and/or one compression spring, because these are cost-effective, simple, robust standard components that can be easily calculated in view of the calculated force of contact pressure. The biasing unit may also comprise a plurality of springs that are preferably arranged in a symmetrical manner relative to the actuation element.

To the extent that the pressure roller carrier has an L-shape, one end of the biasing unit is preferably connected to a first fastening point at the end of the L-shaped pressure roller carrier, and the other end of the biasing unit is connected to a second fastening point on the actuation element, said second fastening point being at a distance from the first fastening point, said distance having the length of the relaxed biasing unit in non-contact position. The actuation element has a projection that abuts against the pressure roller carrier adjacent to the first fastening point when the pressure rollers are in their non-contact position, and the projection of the actuation element is spaced from the first fastening point on the pressure roller carrier by a nip when the pressure rollers are in their contact positions. This results in a defined biasing force of the biasing unit, said force changing only minimally along the biasing path.

Preferably, in the contact position of the pressure rollers, a pulling force is applied to the actuation element. This means that the actuation element can be made in a slimmer and more material-saving design than in a case when pressure would be applied to it, because the risk of buckling does not exist.

Advantageously, the actuation element is composed of a plurality of identical modules that are connected to each other, thus providing a printing machine in a modular design that features possibilities for expansion. It also means that the number of different individual components can be reduced.

Advantageously, the counter roller may be an imaging cylinder of a printing machine. With a soft or elastic imaging cylinder, any flattening caused by the constant abutment of a pressure roller against a point on the circumference leads to significant problems during a subsequent printing operation. This problem has been solved by the device for moving a plurality of pressure rollers, said device permitting, in a simple manner, a lifting of the pressure rollers when the imaging rollers are not rotating.

The problem underlying the invention is also solved by a method for moving a plurality of pressure rollers in a printing machine, wherein a plurality of pressure rollers is simultaneously moved relative to respective counter rollers in a printing machine away from said counter rollers with the aid of a shared actuation element, to which a pulling force is being applied.

In this method, the shared actuation element is preferably attracted with only one actuation device, thus saving individual components and simplifying the control because fewer actuation devices are provided.

The plurality of pressure rollers is advantageously moved relative to the respective counter rollers between a contact and a non-contact position. Intermediate positions of the actuation device are not necessary. Consequently, the control of said actuation device is simplified and the control process is simple.

Advantageously, the pressure rollers are arranged in the non-contact position when the actuation device is in a non-energy mode. When the pressure rollers are not pressed against the counter rollers, it is possible, in the case of soft rollers, to avoid a flattening of the roller material in the contact region.

The invention, as well as additional details and advantages of said invention, will be described hereinafter with reference to preferred embodiments illustrated in the drawings.

DETAILED DESCRIPTION OF THE INVENTION

Figure 1:
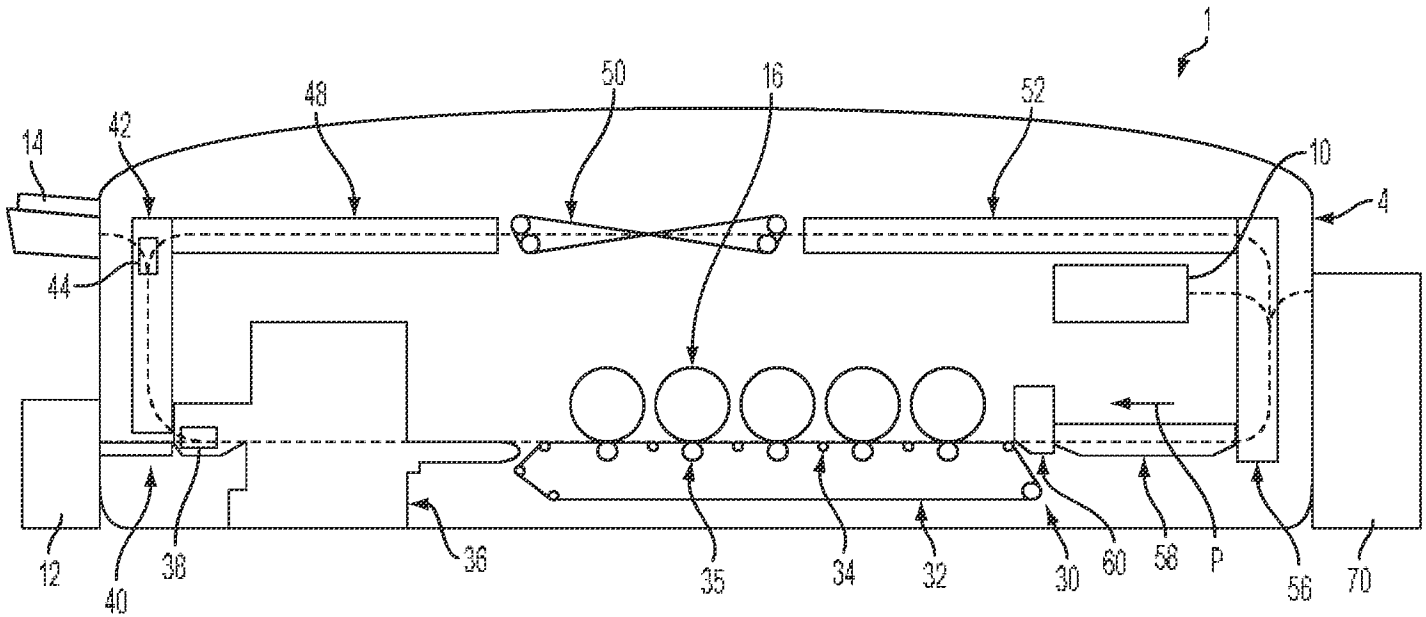
FIG. 1 is a schematic side view of an electrophotographically operating printing machine.

FIG. 1 shows a schematic side view of an exemplary electrophotographically operating printing machine 1 that is designed for sheet printing and that accommodates a device in accordance with the invention. The illustrated printing machine 1 is a printing machine for multi-color printing. In order to simplify the illustration, any housing parts that would usually prevent a view into the interior of the printing machine 1 have been left off.

The printing machine 1 in accordance with FIG. 1 comprises a housing 4, a sheet cassette 10 accommodated in the housing 4, as well as a sheet cassette 70 located outside.

The printing machine comprises electrophotographically operating printing units 16. The printing units 16 are arranged in such a manner that they directly print a sheet. To accomplish this, the printing units are provided directly above a first transport unit 30, said transport unit comprising a transport belt 32 that is moved around a plurality of rollers 34 and defining a sheet moving path P. Arranged opposite the printing units 16 are respective pressure rollers 35 that press a sheet transported through the transport unit 30 against a corresponding transfer element of the printing units 16 in order to permit toner to be transferred directly to a sheet. The transfer element is configured as a roller and may be configured, for example, as an imaging drum on which a toner image is electrophotographically generated. However, the transfer element may also be an intermediate drum that receives a toner image from the imaging drum and then transfers said toner image to a printing material.

Such intermediate drums are known and usually have an elastic surface. Consequently, image transfer stations in the form of a printing nip are formed between the respective transfer elements of the printing units 16 and their opposing pressure rollers 35. Together, the pressure rollers 35 can be moved by means of a device that is not shown in FIG. 1 toward the respective transfer element of the printing units (hereinafter referred to as the counter roller) and away from said transfer element. Hereinafter, different such devices will be explained in detail.

The printing machine comprises, viewed in sheet-moving direction, a fusing station 36 downstream of the first transport unit, said fusing station having a switch 38. Furthermore, corresponding transport units 40, 42, 48, 52 and 56, as well as a sheet turning device 50 are provided between the transport units 48 and 52. A switch 44 is integrated in the region of the transport unit 42.

In addition, the printing machine in accordance with FIG. 1 comprises a preliminary alignment unit 58, as well as an additional alignment unit 60.

Figure 2:
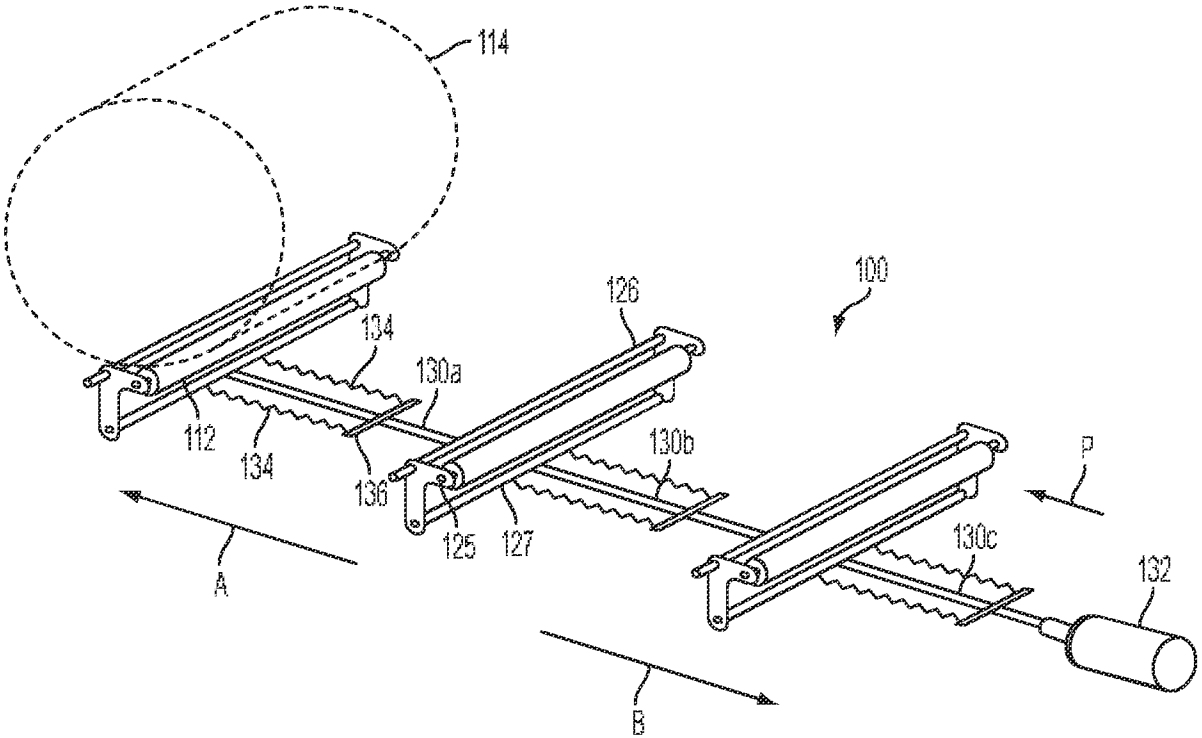
FIG. 2 is a perspective view of a device for moving a plurality of pressure rollers in accordance with a first embodiment.
Figure 3:
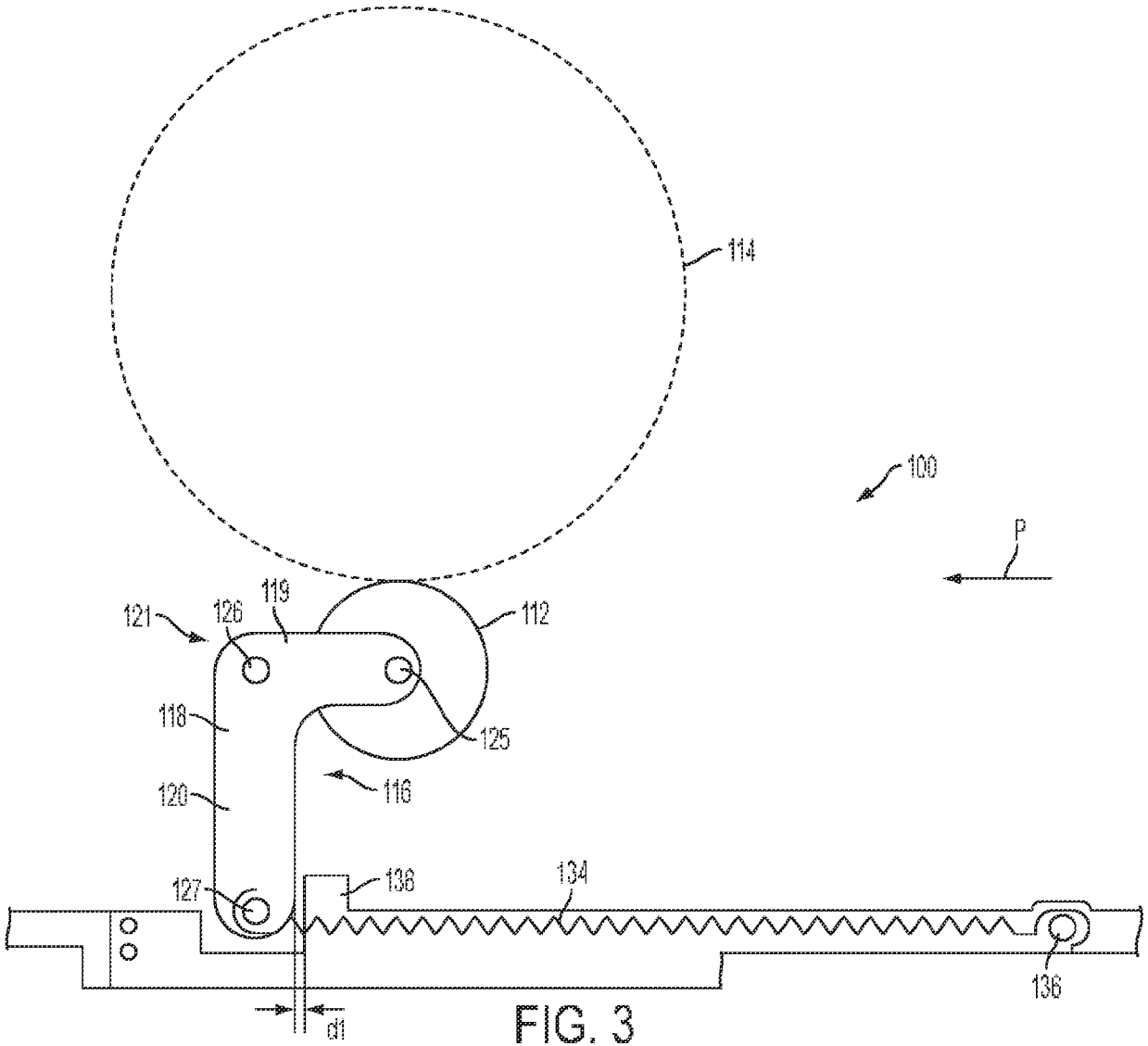
FIG. 3 is an enlarged side view of a region of the device for moving a plurality of pressure rollers, shown in FIG. 2.

Referring to FIGS. 2 and 3, a first embodiment of a device 100 for moving a plurality of pressure rollers will be described. The device 100 is provided for moving a plurality of pressure rollers 112 relative to respective counter rollers 114 in a printing machine that is not specifically illustrated in the drawings. FIG. 2 shows three pressure rollers 112, the number of said pressure rollers that are to be moved, of course, depending on the design of the printing machine, i.e., the number of printing units. FIG. 3 schematically shows only one counter roller 114 in order to simplify the drawing; of course, corresponding counter rollers are provided for each pressure roller. The pairs of pressure rollers 112 and counter rollers 114 are arranged along a substrate or paper moving path P in the printing machine and, in between, form a printing nip. The device 100 comprises a plurality of pressure roller carriers 116, the pressure rollers 112 being supported relative to said pressure roller carriers so as to be rotatable, and respectively two pressure roller carriers 116 supporting one pressure roller 112. The axes of rotation of the plurality of pressure rollers 112 extend parallel to each other and are arranged at a distance from each other along the paper moving path P of the printing machine. It should be noted that the pairs of pressure rollers 112 and counter rollers 114, and the components associated therewith are essentially configured in the same manner. Therefore, if the description hereinafter speaks of a roller pair 112, 114 and the components associated therewith, said roller pair's description can also be applied to the other, equally configured, components.

In each case, the pressure roller carrier 116 is configured as an L-shaped lateral carrier with a first leg 119, a second leg 120 and a lateral carrier center part 121. A bore for receiving one end of a pressure roller axle 125 is provided in the extreme end region of the first leg 119, said axle extending through the pressure roller 112 and supporting said pressure roller in a rotatable manner. Alternatively, of course, the pressure roller 112 could also be rotatably supported in the first leg 119. The pressure roller 112 extends between the two pressure roller carriers 116. A bore is located in the extreme end region of the second leg 120 with a connecting rod 127 extending through said bore and connecting two pressure roller carriers 116. A bore is provided in the lateral carrier center part 121 with a pivot axle 126 extending through said bore, thus allowing the pressure roller carrier 116 to be supported in the housing and to be pivotable relative to the counter roller 114.

The device 100 for moving the pressure rollers further comprises an elongated actuation element 130 and an actuation device 132, said device being connected to the pressure roller carriers 116 via the actuation element 130 and the connecting rod 127. A biasing unit 133 in the form of helical springs 134 extends between the connecting rod 127 and a fastening feature on the actuation element 130.

In FIGS. 2 and 3, the actuation element 130 is shown as an elongated rod that is composed of several segments 130*a*, 130*b*, 130*c*. A plurality of fastening rods 136 is provided on the actuation element 130, said rods projecting on both sides of the actuation element 130. On their one ends, the helical springs 134 are connected to the fastening rods 136 and, on their other ends, to a connecting rod 127. Two helical springs 134 are provided, said springs being symmetrically arranged on both sides of the actuation element 130. Between each pressure roller carrier 116 and the corresponding rod 136 in the actuation element 130, two helical springs 134 are provided, said springs being symmetrically arranged on both sides of the actuation element 130. The helical springs 134 are commercially available tension springs of metal that have eyelets on their ends, these being hinged in the connecting rod 127, on one end and, in the rod 136, on the other end. It should be noted that the helical springs 134 could also be hinged directly in a hole or eyelet in the actuation element 130. The helical springs 134 effect a biasing of the pressure roller carriers 116 in order to pivot the pressure rollers 112 toward the counter rollers 114.

Furthermore, the actuation element 130 comprises an actuation projection 138 that projects upward, from the actuation element 130, in the direction of the pressure roller 112. In its longitudinal direction, i.e., along the paper moving path P, the actuation element 130 can be shifted forward or backward. On its one end (on the right in FIGS. 1 and 2), the actuation element is connected to the actuation device 132, said device being suitable for shifting the actuation element 130 in the direction of arrows A and B.

The actuation device 132 has a non-energy position, in which the actuation element 130 is moved in the direction of arrow A. In an actuated position, the actuation device 132 exerts a pulling force on the actuation element 130 in the direction of arrow B. In the non-energy position of the actuation device 132, the connecting rod 127 of the pressure roller carriers 116 abuts against the projection 138 of the actuation element 130. This may be achieved, for example, by a not illustrated tension spring that is arranged on one end of the actuation element 130 that is opposite the actuation device 132, or by the effect of the spiral springs 134 that exert a pulling force between the rod 136 and the connecting rod 127. In the non-energy position of the actuation device 132, the pressure rollers 112 are not in contact with the counter rollers 114, because, for example, they are pulled downward due to gravity and, together with the pressure roller carrier 116, pivot away from the counter roller 114. Alternatively, they may also be actively pivoted away via the actuation element 130 and a contact between the projection 138 and the connecting rod 127. In the actuated position of the actuation device 132, the actuation element 130 is shifted by a prespecified distance in the direction of arrow B. The rod 136 and the actuation projection 138 are thus also shifted by a prespecified distance in the direction of arrow B in FIG. 2. The actuation projection 138 is spaced from the connecting rod 127 by a distance d1, and the helical springs 134 are tensioned between the rod 136 and the connecting rod 127. The pulling force of the helical spring 134 generates—via the second leg 120—a torque that acts on the pressure roller carrier 116 about the pivot axle 126. As a result of this, the pressure roller carrier 116 and the pressure rollers 112 supported therein are biased relative to their counter rollers 114.

Preferably, the helical springs 134 are selected in such a manner that they display a relatively flat spring characteristic, so that their pulling force changes little, preferably by at most 20 percent, along the distance d1 of the actuation element 130. The force of contact pressure of the pressure roller 112 against the counter roller 114 is determined by the length ratio of the legs 119 and 120, as well as by the weight of the pressure roller 112, and by the pulling force of the helical springs 134 in tensioned state. The helical springs 134 are biased between the rod 136 and the connecting rod 127 in such a manner that, in biased state, approximately 90 percent of the desired contact force is generated between the pressure roller 112 and the counter roller 114.

Hereinafter, the operation of the embodiment of the device 100 for moving a plurality of pressure rollers 112 shown in FIGS. 2 and 3 will be described. First, the actuation device 132 is positioned in its non-energy position, i.e., it does not exert any pulling force on the actuation element 130. In this mode, the helical springs 134 bias the connecting rod 127 against the actuation projection 138 with their bias. Consequently, no torque is generated on the pressure roller carrier 116 about its pivot axle 126. Due to the weight of the pressure roller 112, a clockwise torque is generated on the pressure roller carrier 116, and the pressure roller 112 is in a position in which it is pivoted away from the counter roller 114. This is true of each of the pressure roller carriers 116 that are arranged in a row because they are connected synchronously to the actuation device 132 by the actuation element 130. This position, in which the pressure rollers 112 do not abut against the corresponding counter rollers 114, is referred to as the non-contact position in this case.

In order to bring the pressure rollers 112 in a position in abutment against one of the counter rollers 114, energy is applied to the actuation device 132, e.g., pressurized air is applied in the case of a pneumatic actuation device. The position, in which the pressure rollers 112 abut against the counter rollers 114, is referred to as the contact position herein. When pressurized air is applied to the actuation device 132 it pulls the actuation element 130 to the right in the direction of arrow B. The pulling force exerted by the actuation device 132 is transmitted via the helical springs 134 to the connecting rod 127 of the pressure roller carrier 116. As a result of this pulling force of the helical springs 134, a counterclockwise torque is applied to the pressure roller carrier 116, as a result of which the pressure roller 112 connected therewith is pivoted toward the corresponding counter roller 114 until said pressure roller abuts against said counter roller.

As soon as the pressure roller 112 abuts against the counter roller 114, an additional movement of the actuation element 130 in the direction of arrow B causes the actuation projection 138 to be moved away to the right of the connecting rod 127. In this manner, the helical springs 134 are further biased, thus intensifying the force of contact pressure of the pressure roller 112 against the counter roller 114.

Inasmuch as the helical springs 134 preferably display a flat spring characteristic and inasmuch as the ultimate distance d1 between the actuation projection 138 and the connecting rod 127 is relatively small in relation to the unbiased length of the helical springs 134, the force of contact pressure between the pressure rollers 112 and the counter rollers 114 does not change very much over the distance d1. Preferably, the force of contact pressure—from the beginning to the end of the distance d1—changes by less than 20 percent. Inasmuch as all the successively arranged pressure roller carriers 116 are connected in a row by the actuation element 130, all the pressure roller carriers 116 are pivoted at the same time.

Figure 4:
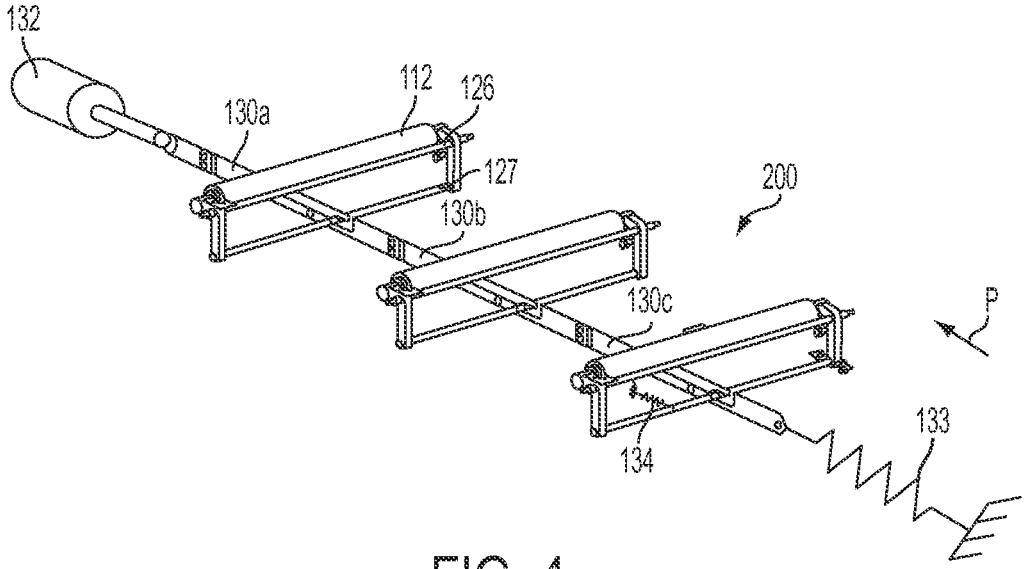
FIG. 4 is a perspective view of a device for moving a plurality of pressure rollers in accordance with a second embodiment.
Figure 5:
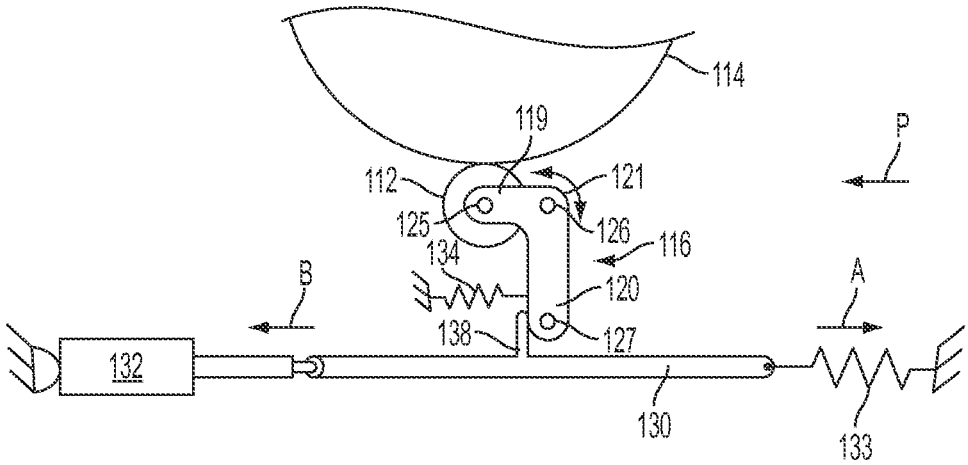
FIG. 5 is a side view of the device for moving a plurality of pressure rollers, shown in FIG. 4.

FIGS. 4 and 5 show a second embodiment of an actuation device 200 for moving a plurality of pressure rollers 112. Wherever possible, the same reference symbols are used for the same or similar components as are for the description of the first embodiment shown by FIGS. 2 and 3. FIG. 4, again, shows three pressure rollers 112 that are supported by corresponding pressure roller carriers 116 so as to be rotatable and pivotable. In order to simplify the illustration, corresponding counter rollers have been left out of FIG. 4, said counter rollers being located opposite the pressure rollers 112 along a paper moving path P in a printing machine 1, as indicated in FIG. 5.

The pressure roller carriers 116 are configured as described above and will thus not be described in greater detail. Again, they are connected via the pressure rollers 112 and the connecting rods 127.

The device 200 for moving a plurality of pressure rollers 112 comprises an elongated actuation element 130 that is composed of several segments 130*a*, 130*b*, 130*c*. Each of the segments 130*a*, 130*b*, 130*c*, for example, may be uniformly shaped, punched pieces of sheet metal, said pieces of sheet metal being provided with fastening openings in their end regions. The segments may be slightly bent in one end region in order to receive an end region of an adjacent segment. The actuation element 130 extends along the paper moving path P through the housing of the printing machine 1 below the successively arranged pairs of pressure rollers 112 and counter rollers 114. The actuation element 130 has an actuation projection 138 that projects from the actuation element 130 in the direction of the pressure roller carrier 116 and is suitable to come into engagement with the connecting rod 127, as indicated in FIG. 5. However, it is also possible to punch out an appropriate opening in the respective segments to accommodate a connecting rod 127, said connecting rod defining an actuation edge. As can best be seen in FIG. 5, the one end of the actuation element 130, on the right in FIG. 5, is connected to a return spring 133, said spring, in turn, being connected to the housing of the printing machine 1. The other end of the actuation element 130, the left end in FIG. 4, is connected to an actuation device 132 that is permanently connected to the housing of the printing machine 1.

The actuation device 132 may have any design of an actuation device, said design being suitable to apply a pulling force to the actuation element 130. In the present embodiment, the actuation device 132 is a pneumatic cylinder 132.

A biasing unit 134 is connected to the connecting rod 127 of the pressure roller carrier 116; however, for example, said connecting rod may also be connected to the second leg 120 of the lateral carrier 118. The other end of the biasing unit 134 is connected to the housing of the printing machine 1 and is suitable to exert a pulling force on the pressure roller carrier 116. As a result of this, a clockwise torque of the pressure roller carrier 116 is generated about the pivot axle 126. Preferably, the biasing unit 134 consists of one or several helical springs 134 displaying a flat spring characteristic. The helical springs 134 are commercially available tension springs of metal, said springs having eyelets on their end, said eyelets being applied, on one end, to the connecting rod 127 and being applied, on the other end, to the housing of the printing machine.

The bias of the spiral springs 134 is selected in such a manner that, taking into consideration the lengths of the first and second legs 119, 120, as well as the weight of the pressure rollers 112, a desirable force of contact pressure is generated between the pressure roller 112 and the corresponding counter roller 114. The combined biasing force of all the helical springs 134 is smaller than the biasing force of the return spring 133, that is tensioned between the housing of the printing machine 1 and the actuation element 130.

The actuation device 132 has a non-energy position, in which pressurized air is not applied thereto, and has an actuated position, in which pressurized air is applied thereto and exerts a pulling force on the actuation element 130. In the actuated position, the actuation device 132 pulls the actuation element 130 to the left in the direction of arrow B. The actuation projection 138 is removed in this position. Consequently, the connecting rod 127 is not blocked by the actuation projection 138, and the pressure roller carrier 116 can pivot about the pivot axle 126. The pulling force of the helical springs 134 generates a torque about the pivot axle 126, so that the pressure roller 112 is held in a position in contact with the counter roller 114.

In the not actuated or non-energy position of the actuation device 132, the actuation element 130 is moved to the right in the direction of arrow A in FIG. 5, and the actuation projection 138 abuts against the connecting rod 127. The actuation element 130 is shifted in the direction of arrow A because the biasing force of the return spring 133 is greater than the combined pulling force of the helical springs 134 in the direction of arrow B. In this position, the pressure roller carrier 116 is pivoted counterclockwise, and the pressure roller 112 is at a distance from the counter roller 114.

Hereinafter, the operation of the second embodiment of the device 200 shown in FIGS. 4 and 5 will be described. In the non-energy position of the actuation device 132, the actuation element 130 is pulled by the pulling force of the return spring 133 to the right in the direction of arrow A. The actuation projection 138 abuts against the connecting rod 127 and pulls said rod with it to the right in the direction of arrow A, so that the pressure roller carrier 116 pivots counterclockwise about the pivot axle 126. As a result of this, the pressure roller 112 is spaced from the counter roller 14, i.e. the pressure roller is not in contact with the counter roller 114.

Thereafter, the actuation device 132 is supplied with energy, i.e., pressurized air is applied. The actuation device 132 pulls the actuation element 130 to the left in the direction of arrow B. As a result of this, the actuation projection 138 also moves to the left and moves away from the connecting rod 127. Consequently, the pressure roller carrier 116 can freely rotate about the pivot axle 126. The pulling force of the helical springs 134 generates a clockwise torque on the pressure roller carrier 116. As a result of this, the pressure roller carrier 116 with the pressure roller 112 pivots in the direction of the counter roller 114 until the pressure roller 112 abuts at a predefined force of contact pressure against said pressure roller's counter roller 114.

If the supply of pressurized air to the actuation device 132 is stopped, the return spring 133 pulls the actuation element 130 to the right in the direction of arrow A. Then, the actuation projection 138 comes again into engagement with the connecting rod 127, thus pivoting the pressure roller carrier 116 and the pressure roller 112 in downward direction away from the counter roller 114.

Considering this embodiment, it would also be possible to omit the return spring 133 and, instead of said spring, arrange the actuation device 132 in such a manner that said actuation device may pull the actuation element 130—against the force of the springs 134—into a position, in which the pressure roller carriers 116 move the pressure rollers away from the respective counter rollers. Preferably, this should automatically take place in a non-energy mode of the actuation device 132.

Figure 6A:
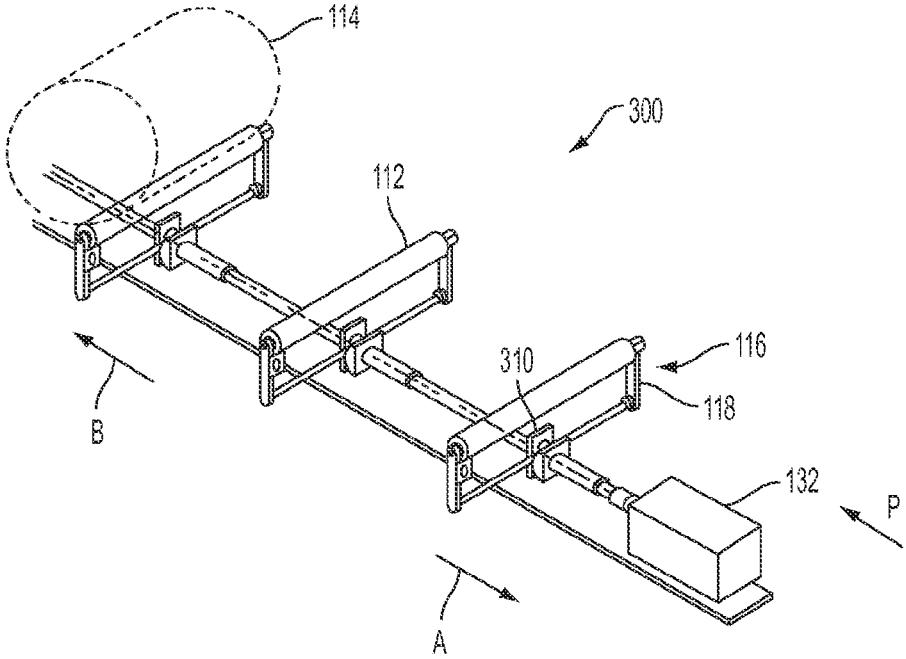
FIG. 6*a* is a perspective view of a device for moving a plurality of pressure rollers in accordance with a third embodiment.
Figure 6B:
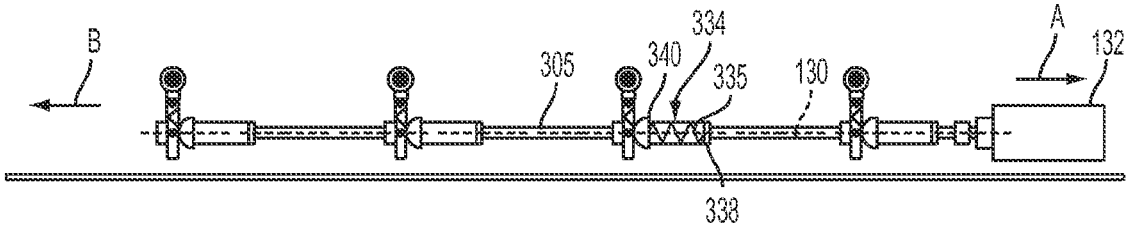
FIG. 6*b* is a side view of the device for moving a plurality of pressure rollers, shown in FIG. 6*a*.
Figure 7:
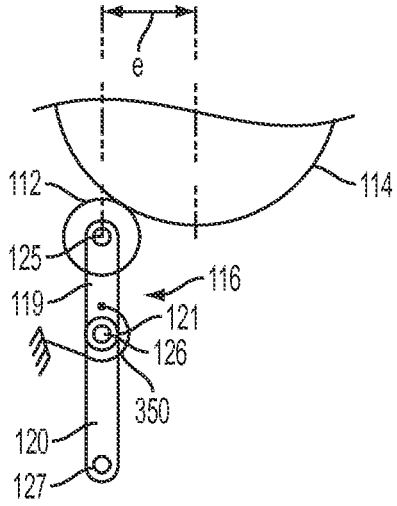
FIG. 7 is a detailed view of a part of the device for moving a plurality of pressure rollers, shown in FIG. 6.

Referring to FIGS. 6 and 7, a third embodiment of a device 300 for moving a plurality of pressure rollers 112 will now be described, with the same reference symbols as before being used, provided they describe the same or similar elements. FIG. 6*a* shows a schematic, perspective view of the device, with only three pressure rollers and one counter rollers being shown. FIG. 6*b* shows a schematic side view of the device where, now, four pressure rollers can be seen; and FIG. 7 shows an enlarged schematic view of a detail of a region of the device 300. In a printing machine not shown, a plurality of pressure rollers 112 are arranged opposite the respective counter rollers 114 along a paper moving path P. The device 300 for actuating a plurality of pressure rollers 112 comprises pressure roller carriers 116 associated with each pressure roller 112, said pressure roller carrier supporting the pressure rollers 112 so that they can be pivoted relative to the respective counter roller 114. The device 300 comprises an actuation element 130, as well as an actuation device 132.

In this embodiment, the pressure roller carriers 116 are designed as rod-shaped lateral carriers. Each of the pressure roller carriers 116 has a lateral carrier center part 121 from which extends a first leg 119 in upward direction and a second leg 120 in downward direction. A bore is provided in the extreme outer end of the first leg 119, with a pressure roller axle 125 extending through said bore. A bore is provided on the outer end of the second or lower leg 120, with a connecting rod 127 extending through said bore. A bore is provided in the lateral carrier center part 121, with a pivot axle 126 extending through said bore. The pivot axle 126 supports the pressure roller carrier 116 so that it is pivotable relative to the housing of the printing machine. The pressure rollers and the connecting rod 127 thus each connect two pressure roller carriers 116.

As is best seen in FIG. 7, a center point (the axis of rotation) of the counter roller 114 is offset in horizontal direction by a distance e in horizontal direction relative to the pivot axle 126 of the pressure roller carrier 116. When the pressure roller 112 is in a position of contact with the counter roller 114, the orientation of the pressure roller carrier 116 is approximately perpendicular. Different from the first two embodiments as shown in FIGS. 2 through 5, in this embodiment, the pressure roller 112 does not press directly against the counter roller 114 below an axis of rotation of said counter roller.

The actuation device 132 of the embodiment shown in FIGS. 6 and 7 is a pneumatic cylinder 132, but it may also be any other suitable design of an actuation device. The actuation device 132 is in non-energy mode in which no pressurized air is applied to said actuation device. Furthermore, the actuation device 132 is in an actuated mode in which pressurized air is applied to said actuation device, and a force of pressure is applied to the actuation member 130. In FIGS. 6 and 7, this force of pressure extends in the direction of arrow B, i.e., said force is directed toward the left.

The actuation element 130 is again composed of several segments. Each of the segments comprises a rod element 305 that bears a connector 310 on one end and a biasing unit 334 on the other end, with a corresponding segment with a biasing unit 334 being provided for each pressure roller 112. Each of the biasing units 334 comprise spiral compression springs 335 that, on one side, abut against a counter bearing 338 that is stationary with respect to the rod element 305 and, on the other side, abut against a print head 340 that can be moved relative to the rod element, and is mounted in between. The spiral compression spring 335 is guided in a suitable manner in order to prevent buckling or jumping away when said spring is in compressed state. The movement of the print head 340 relative to the rod element 305 is limited in a suitable manner, for example by appropriate stops on the rod element. Each print head 340 of one segment is connected to a connector 310 in such a manner that a connecting rod 127 is rotatably accommodated in between. Thus, the connecting rod 127 can be moved in a printing direction of the print head 340 and can be moved by the print head 340 in a direction opposite thereto. The adjacent rod elements are also connected to each other via the print head 340 and the connector 310.

In the actuated position of the actuation device 132, the actuation member 130 is shifted by a prespecified distance in the direction of arrow B. In the actuated position, the biasing units 334 push the connecting rod 127 in the direction of arrow B, as a result of which a clockwise torque is applied to the pressure roller carrier 116. Thus, in the actuated position of the actuation device 132, the pressure roller 112 abuts against the counter roller 114 with a prespecified force of contact pressure. Furthermore, the actuation device 132 has a non-energy or not actuated position, in which pressured air is not applied thereto. In the not actuated or non-energy position, the helical springs 134 are relaxed and do not exert any force on the respective connecting rod 127. Consequently, no torque acts about the pivot axle 126 of the pressure roller carrier 116, and the pressure roller 112 is not pushed against the counter rollers 114.

In the embodiment of FIGS. 6 and 7, a return spring 350 may optionally be provided, as is best seen in FIG. 7. The return spring 350 is shown as a spiral spring, one end of said spiral spring being connected to the housing of the printing machine and its other end being connected to the pressure roller carrier 116. The return spring 350 is biased in such a manner that it generates a counterclockwise torque, i.e., a torque that swivels the pressure roller 112 away from the counter roller 114. This has the effect that the pressure roller 112 and the counter roller 114 are safely moved apart from each other in the non-energy or not actuated position of the actuation device 132.

Hereinafter, the operation of the embodiment of the device 300 for actuating a plurality of pressure rollers 112 shown in FIGS. 6 and 7 will be described. Initially, the actuation device 132 is in non-energy mode, i.e., pressurized air is not applied to said actuation device. No force acts on the actuation element 130, and, in general, said actuation element is shifted to the right in FIG. 7. The pressure rollers 112 are in a non-contact position, i.e., they do not abut against the counter roller 114.

In order to actuate the pressure rollers 112, pressurized air is applied to the actuation device 132. Then, the actuation device 132 moves in the direction of arrow B into its actuated position, whereby said actuation device exerts a pressure to the left on the actuation element 130. The biasing units 334 provided on the actuation element 130 pivot the pressure roller carriers in such a manner that the pressure rollers 112 come to abut against their respective counter rollers 114. During a continued movement of the actuation element, the biasing units 334 are compressed in such a manner that the respective biasing units are essentially compressed in a uniform manner and thus each build up a uniform bias of the pressure rollers 112 against their respective counter rollers 114. In particular, the helical springs 335 are compressed by a prespecified distance, and thus the prespecified force of contact pressure between the pressure roller 112 and the counter roller 114 is generated.

When the actuation device 132 is again in non-energy mode, i.e., the pressurized air is discharged, a force directed to the left on the actuation element 130 is no longer applied, and the helical springs 335 can relax. Consequently, the helical springs 335 no longer exert any force against the connecting rod 127 of the respective pressure roller carrier 116, and a clockwise torque is no longer generated on the pressure roller carrier 116. The optionally present spiral spring or return spring 350 aids the pivoting of the pressure roller carrier 116 away from the counter roller 114.

It should be noted that all three embodiments provide an emergency shutoff function to the extent that, in non-energy mode of the actuation device 132, the pressure rollers 112 do not abut against their respective counter rollers 114. A printing machine 1 comprises many rollers that have a soft surface such as is the case, for example, with an imaging cylinder, rubber pressure rollers, etc. If rollers having a soft surface are being permanently pressed against a counter-part, irrespective of whether it is a different roller or a planar surface, this may result in a local flattening of the contact region of the roller having the soft coating. The devices 100, 200 and 300 in accordance with the present disclosure avoid this disadvantage of prior art. All three embodiments have in common that the pressure roller 112 and the counter roller 114, for example an imaging cylinder, do not contact each other in a non-energy position of the actuation device 132, or at least no force of contact pressure is applied to them. Damage or local flattening of the rollers is thus automatically prevented in case of malfunction. Although this is of advantage, it may also be possible to provide a device that, in energized mode, will move the pressure rollers 112 away from the corresponding counter rollers 114. Furthermore, it should be noted that, in all three embodiments, more than two pressure roller carriers 116 may be provided per pressure roller 112. Considering the respective length of the pressure and counter rollers 112, 114, it is possible that a deflection of the rollers 112, 114 will occur. Therefore, it may be necessary to support in particular the smaller pressure roller 112 at several points along its length. Therefore, the pressure roller 112 could be divided into several parts, for example into two or three parts so that then three or four pressure roller carriers 116 could be provided, said pressure roller carriers being arranged not only on both sides, but at regular distances along the length of the connecting rod 127 and the pressure roller 112.

Furthermore, it should be noted that the biasing units 134, 334 could be any biasing unit that is suitable to exert a pressure force or pulling force on the pressure roller carrier 116. In the shown embodiments, helical springs of metal are respectively provided as biasing elements 134, 350. These components that are easy to dimension and are cost-effective are commercially available in a multitude of modifications. It is also possible to use other biasing elements such as, for example, gas pressure springs or rubber spring elements, these potentially providing additional damping functions.

Furthermore, it should be noted that different designs of actuation devices 132 may be used as the actuation device 132, for example, hydraulic or electromagnetic actuation devices.

The invention was described with reference to preferred embodiments, where the individual features of the described embodiments can be freely combined and/or interchanged with each other, provided that they are compatible. For the person skilled in the art, numerous modifications and configurations are possible and obvious, without departing from the inventive idea.

The invention claimed is:

1. A device for moving a plurality of pressure rollers relative to respective counter rollers in a printing machine, said device comprising:

a plurality of movably supported pressure roller carriers, each supporting respectively one pressure roller, said pressure roller carriers being movable between a contact position and a non-contact position, with each of said pressure roller carriers being biased via a biasing unit in a direction of the contact position; and at least one actuation element connecting at least two pressure roller carriers to a shared actuation device, wherein the pressure roller carriers are adapted to automatically move to the non-contact position when the actuation device is in its non-energy mode.

2. Device for moving a plurality of pressure rollers as in claim 1, wherein the actuation device has an actuated and a non-actuated position.

3. Device for moving a plurality of pressure rollers as in claim 1, with the pressure roller carrier supporting the pressure roller so that said pressure roller carrier can be pivoted relative to the counter roller.

4. Device for moving a plurality of pressure rollers as in claim 3, with the pressure roller carriers having an L-shape and with the pivot axle being arranged in the region of the bend of the L-shape.

5. Device for moving a plurality of pressure rollers as in claim 4, with one end of the biasing unit being connected to a first fastening point at the end of the L-shaped pressure roller carrier, and the other end of said biasing unit being connected to a second fastening point on the actuation element, said second fastening point being at a distance from the first fastening point, said distance having the length of the relaxed biasing unit, with the actuation element having a projection that abuts against the pressure roller carrier adjacent to the first fastening point when the pressure rollers are in their non-contact position, and said projection of the actuation element being spaced from the first fastening point on the pressure roller carrier by a nip when the pressure rollers are in their contact position.

6. Device for moving a plurality of pressure rollers as in claim 1, with the contact region between the pressure roller and the counter roller being vertically below the axis of rotation of the counter roller.

7. Device for moving a plurality of pressure rollers as in claim 1, with the biasing unit being arranged between the pressure roller carrier and a fixed frame of the printing machine.

8. Device for moving a plurality of pressure rollers as in claim 1, with the biasing unit being arranged between the pressure roller carrier and the actuation element.

9. Device for moving a plurality of pressure rollers as in claim 1, with the biasing unit being at least partially relaxed relative to the contact position when the pressure rollers are in the non-contact position.

10. Device for moving a plurality of pressure rollers as in claim 1, with the biasing unit comprising a tension spring.

11. Device for moving a plurality of pressure rollers as in claim 1, with the biasing unit comprising a compression spring.

12. Device for moving a plurality of pressure rollers as in claim 10, with the biasing unit comprising a plurality of springs that are arranged in a symmetrical manner relative to the actuation element.

13. Device for moving a plurality of pressure rollers as claim 1, with a pulling force being applied to the actuation element in the contact position of the pressure rollers.

14. Device for moving a plurality of pressure rollers as in claim 1, with the actuation element being composed of a plurality of identical modules that are connected to each other.

15. Device for moving a plurality of pressure rollers as in claim 1, with the counter roller being an imaging cylinder of a printing machine.

16. A device for moving a plurality of pressure rollers relative to respective counter rollers in a printing machine, said device comprising:

a plurality of movably supported pressure roller carriers, each supporting respectively one pressure roller, said pressure roller carriers being movable between a contact position and a non-contact position, with each of said pressure roller carriers being biased via a biasing unit in the direction of the contact position; and at least one actuation element connecting at least two pressure roller carriers to a shared actuation device: wherein the pressure roller carriers are in the non-contact position when the actuation device is in its non-energy mode, with the actuation device comprising an actuation device of the group comprising the following: a pneumatic actuation device, a hydraulic actuation device or an electromagnetic actuation device.

17. A method for moving a plurality of pressure rollers relative to respective counter rollers in a printing machine, the method comprising simultaneously moving a plurality of pressure rollers away from the counter rollers with the aid of a shared actuation element to which a pulling force is being applied, the shared actuation element being attracted with only one actuation device; with the actuation device, when in its non-energy mode, automatically moving the pressure rollers away from the counter rollers in order to arrange them in a non-contact position.

* * * * *